US006630907B1

(12) United States Patent
Ryken et al.

(10) Patent No.: US 6,630,907 B1
(45) Date of Patent: Oct. 7, 2003

(54) BROADBAND TELEMETRY ANTENNA HAVING AN INTEGRATED FILTER

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/191,110

(22) Filed: Jul. 3, 2002

(51) Int. Cl.[7] ..... H01Q 1/36

(52) U.S. Cl. ..... 343/700 MS; 343/705; 343/846

(58) Field of Search ..... 343/700 MS, 705, 343/745, 749, 846, 909

(56) References Cited

U.S. PATENT DOCUMENTS

| | | | | | |
|---|---|---|---|---|---|
| 5,410,322 | A | * | 4/1995 | Sonoda | 343/700 MS |
| 6,326,923 | B2 | * | 12/2001 | Shigihara | 343/700 MS |
| 6,392,602 | B2 | * | 5/2002 | Kawahata et al. | 343/700 MS |
| 6,396,442 | B1 | * | 5/2002 | Kawahata et al. | 343/700 MS |
| 6,466,172 | B1 | * | 10/2002 | Ryken et al. | 343/700 MS |
| 6,549,168 | B1 | * | 4/2003 | Ryken et al. | 343/700 MS |

* cited by examiner

*Primary Examiner*—Tan Ho
(74) *Attorney, Agent, or Firm*—David S. Kalmbaugh

(57) ABSTRACT

A microstrip telemetry antenna adapted for use on a small diameter projectile. The antenna includes a filter integrally formed with the antenna. The antenna also has a first pair of tuning tabs and a second pair of tuning tabs which are approximately perpendicular to one another and which allow the antenna to tuned within the S-band of 2.2 to 2.3 GHz.

23 Claims, 2 Drawing Sheets

BROADBAND TELEMETRY ANTENNA HAVING AN INTEGRATED FILTER

BACKGROUND OF THE INVENTION

1. Field of the Invention

The present invention relates generally to an antenna for use on a projectile. More specifically, the present invention relates to a microstrip antenna, designed for use with projectile, which includes a telemetry antenna and a filter for for transmitting to a ground station.

2. Description of the Prior Art

There is currently a need for a microstrip antenna which may used on a projectile to transmit flight performance information for the projectile during a test flight to a ground station or other receiving station. The flight performance information needs to transmitted to the ground or other receiving station to allow for a thorough analysis of flight data and thus insure that the projectile is performing within the performance design criteria for the missile.

There is also a need to insure that the microstrip antenna be light weight and small diameter so that the antenna does not adversely impact the aerodynamic properties of the projectile during a test flight. This insures that telemetry data being transmitted to the ground station accurately reflects the flight performance characteristics of the projectile.

There is also a need for a microstrip antenna which can withstand the G forces exerted on the antenna during a test flight which may cause damage to the antenna or cause the antenna to separate from the projectile. G forces exerted on a microstrip antenna during a test flight of a projectile may be as much as 80,000 G's Further, there is a need to insure that antenna operate over the S-Band Frequency range of 2.2–2.3 GHz. In addition, the antenna should include a filter which filters signals outside of the S-Band Frequency range. For example, GPS antennas receive data via RF signals having a center frequency around 1575 MHz. The filter should be designed to filter out these signals.

There is also a need to allow for an adjustment of the bandwidth of the antenna about a center frequency of 2.25 GHz with the adjustment to be up to 50 MHz.

SUMMARY OF THE INVENTION

The present invention overcomes some of the disadvantages of the past including those mentioned above in that it comprises a small diameter microstrip antenna which includes a filter integral thereto. The microstrip antenna of the present invention is adapted for use on a projectile where G Forces may reach 80,000 Gs or more. The antenna is a broadband microstrip antenna designed to transmit telemetry data to a ground or other type of receiving station for analysis of the data by the user of the antenna. The antenna is designed to be lightweight so as not to effect the aerodynamic properties of the projectile during a test flight. The antenna is capable of withstanding G forces of up to 80,000 Gs. A first pair of tuning tabs and a second pair of tuning tabs positioned approximately perpendicular to one another allow a user to adjust the bandwidth of the antenna up to 50 MHz about its center frequency of 2.25 GHz.

DETAILED DESCRIPTION OF A PREFERRED EMBODIMENT OF THE INVENTION

Figure 1:
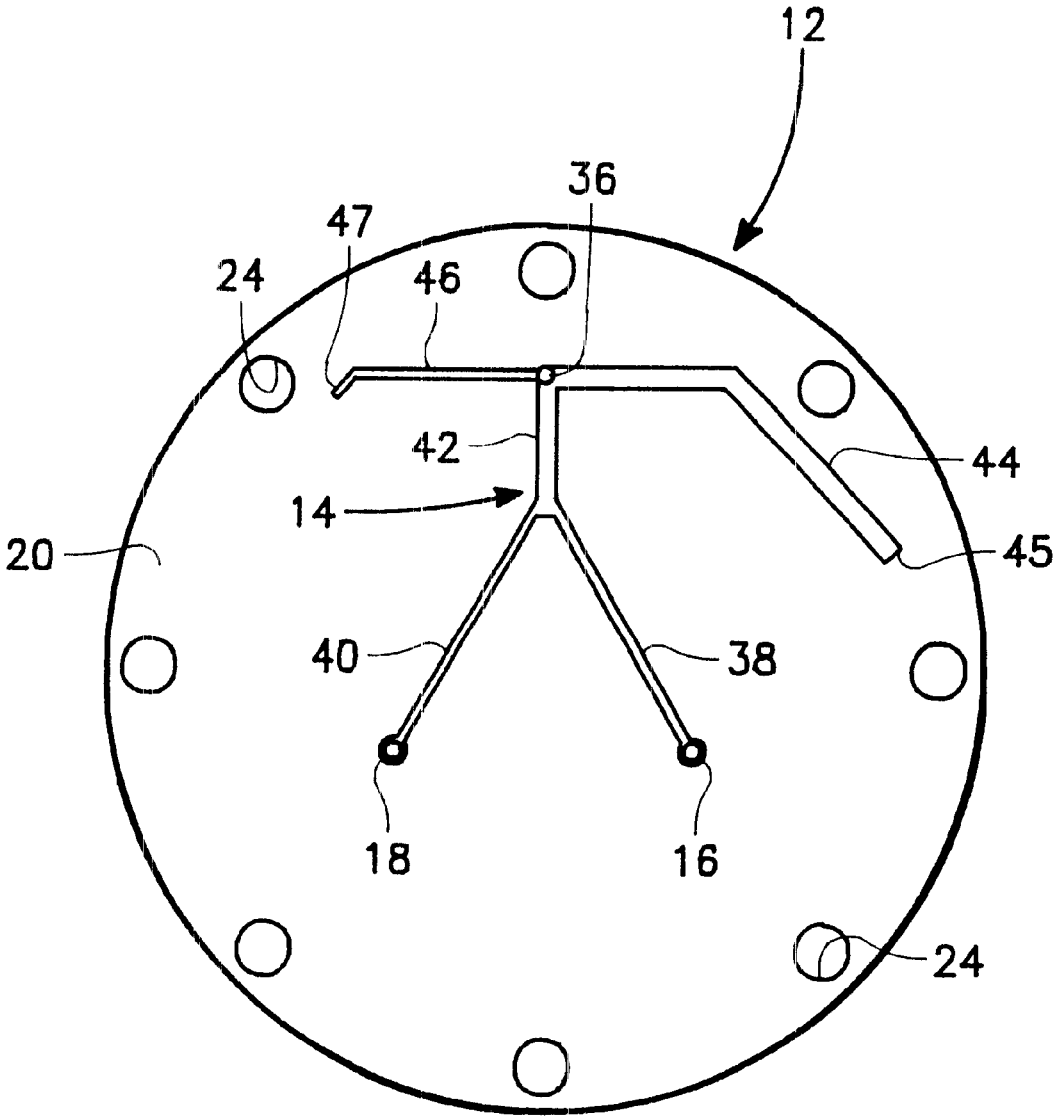
FIG. 1 is a view of the radiating element for the broadband telemetry antenna constituting the present invention.
Figure 2:
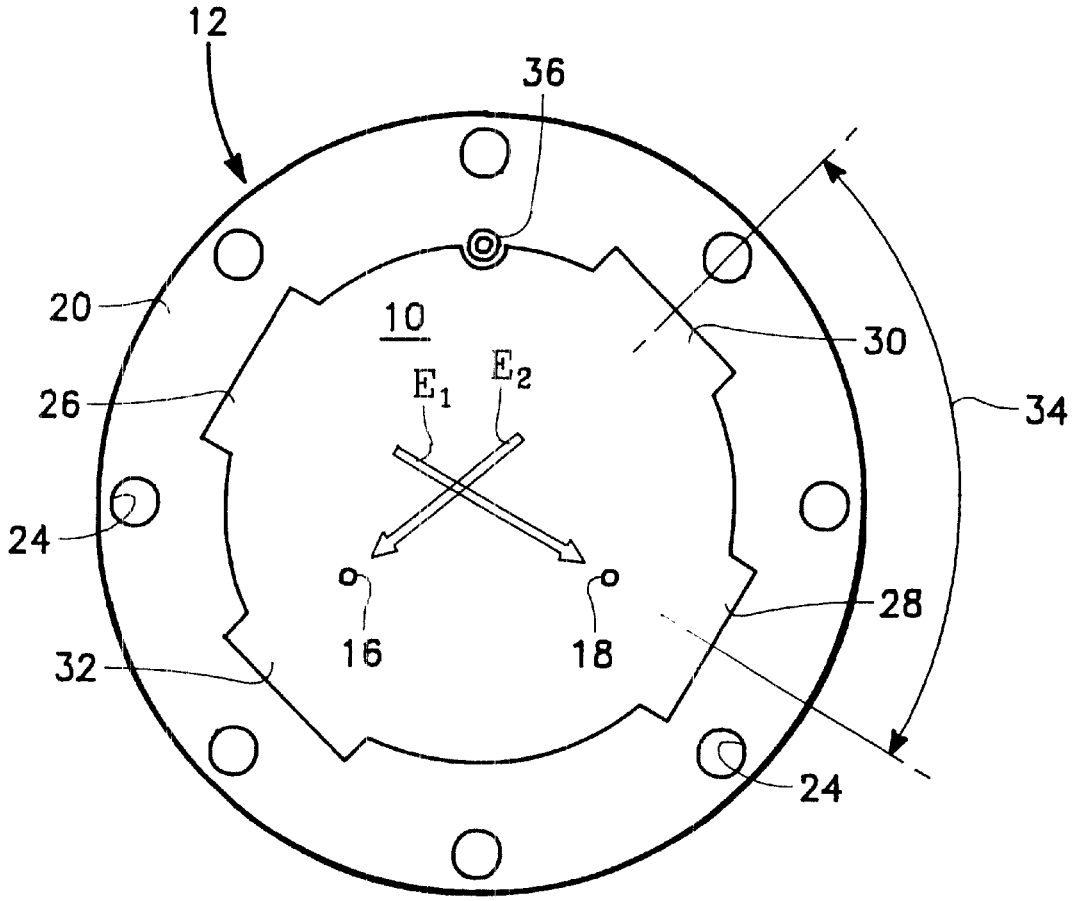
FIG. 2 is filter for the broadband telemetry antenna constituting the present invention.
Figure 3:
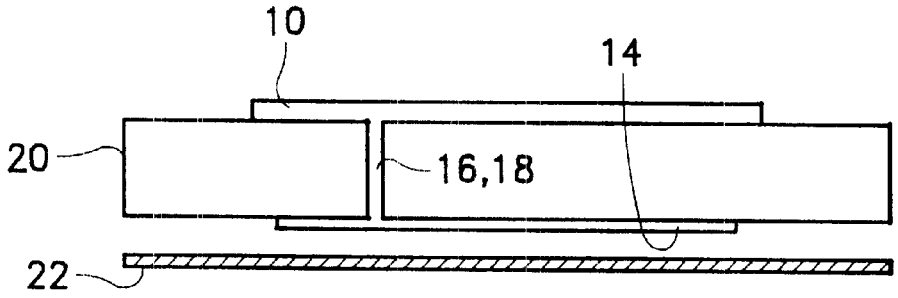
FIG. 3 is a side view of the broadband telemetry antenna of FIGS. 1 and 2 which illustrates the ground plane, filter and radiating element stacked on top of one another.

Referring to FIGS. 1, 2 and 3, there is shown FIG. 2 a radiating element/patch 10 for the broadband telemetry antenna 12 which constitutes the present invention. FIG. 1 depicts a filter 14 for antenna 12 which is electrically connected to radiating element 10 by a pair of copper vias or plated through connecting pins 16 and 18. The copper plated connecting pins 16 and 18 are the feeds for radiating element 10. The radiating element 10 of antenna 12 is mounted on the upper surface of a dielectric substrate 20, while the filter 14 of antenna 12 is mounted on the bottom surface of antenna 12.

As is best illustrated in the FIG. 3 cut away view of antenna 12, the dielectric substrate 20 is proximity to and positioned above a copper ground plane 22. The dielectric substrate 20 may be fabricated from a laminate material RT/Duroid 6002 commercially available from Rogers Corporation of Rogers Conn. This material allows sufficient strength and physical and electrical stability to satisfy environmental requirements and is also easily mounted on the surface of a missile or a target drone. The dielectric substrate 20 may be fabricated from two layers of 0.031 inch thick material, and a 0.010 inch thick antenna protective cover board for the antennas radiating element 10 and filter 14. The use of the multi-layer fabrication to fabricate the substrate is to prevent wrinkling and cracking of the substrate.

Referring to FIG. 2, the dielectric substrate 20 has the shape of a circle with a diameter of about 1⅜ inches. Positioned around the circumference of dielectric substrate 20 are a plurality of equally spaced apart mounting holes 24 which are adapted for mounting the antenna 12 to a projectile.

The radiating element 10 for antenna 12 is also circular in shape and is adapted to transmit an RF (radio frequency) signal within the S-band frequency range of 2.2–2.3 GHZ. The diameter of radiating element is approximately ⅞ of an inch. Radiating element 10 includes a first pair of tuning tabs 26 and 28 which are positioned 180° from one another about the circumference of radiating element 10. Radiating element 10 also includes a second pair of tuning tabs 30 and 32 which are positioned 180° from one another about the circumference of radiating element 10. The angle between adjacent tuning tabs 28 and 30 is approximately 80° as is best indicated by arrow The upper surface of dielectric substrate 20 also has an isolated feed input 36. The feed input 36, which is a 50 ohm input and is electrically connected to filter 14, passes through dielectric substrate 20 to the filter 14.

Referring now to FIG. 1, filter 14 includes a pair of 100 ohm transmission lines 38 and 40 which are connected to one end of a 50 ohm transmission line 42. The opposite end of 50 ohm transmission line 42 is connected to feed input 36. Transmission lines 38 and 40 extend from transmission line 42 at angles of about 35°. Filter 14 also has a pair of filter stubs 44 and 46 which extend from feed input 26 and are perpendicular to transmission line 42. Stubs 44 and 46 have their respective ends 45 and 47 angled downward at approximately 45°. Filter 14 is designed to isolate a transmitted telemetry signal in the 2.2–2.3 GHz range from a GPS signal received by a GPS antenna (not shown) which generally operate in the L1 Band at a frequency of approximately 1575 MHz. Stub 44 is a quarter wavelength stub which is open circuited and filters out signals at 1575 MHz. Stub 46, which is also open circuited, enhances the bandwidth of filter 14 around 1575 MHz. The GPS antenna is generally close to the antenna on the projectile which necessitates the integration of a filter with the radiating element of antenna 12.

At this time it should be noted that antenna 12 was designed to operate in the S-band frequency range of 2.2–2.3 GHz, but has the capability to operate at frequencies of 2.37 GHz. The polarization of antenna 12 has two modes resulting from the two feeds 16 and 18 to radiating element 10 of antenna 12.

The feed points 16 and 18 generate a first vector $E_1$ across the radiating element 10 and a second vector $E_2$ which is also across the radiating element 10 and is around 80° from the first vector $E_1$, that is the vector $E_1$ is almost perpendicular to the vector $E_2$. By adjusting the size of the tuning tabs 26, 28, 30 and 32 the resonant frequency for each mode can be adjusted about the center frequency of 2.25 GHz for antenna 12. The adjustment in the size of the tuning tabs may be about one ten thousandths of inch to adjust the bandwidth of antenna 12 about its center frequency. The user can adjust one pair of tuning tabs to set the upper frequency limit for antenna 12 in the range of 2.25 to 2.30 GHz and the other pair of the tuning tabs to set the lower frequency limit for antenna 12 in the range of 2.00 to 2.25 GHz. Thus, each mode of antenna can be adjusted 50 MHz about the antenna's center frequency of 2.25 GHz, that is the two modes can be pulled apart to provide for broad bandwidth antenna and put the modes together to provide for a narrow bandwidth antenna. Each of the modes for antenna 12 is a linear polarization mode.

The antenna 12 is designed for use with a projectile which has a requirement for a 30,000 Gs. The antenna 12 has survived testing of a projectile having a force of 80,000 Gs exerted on the projectile. The diameter of the antenna 12 is about 1.375 inches.

The radiating patch 10 and the filter 14 are each fabricated from etched copper.

From the foregoing, it is readily apparent that the present invention comprises a new, unique, and exceedingly broadband telemetry antenna having a filter for use with a small diameter projectile, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A broadband telemetry antenna for use on a projectile comprising:

a ground plane adapted for mounting on said projectile;

a dielectric substrate positioned above said ground plane, said dielectric substrate having an upper surface and a lower surface, said dielectric substrate being configured as a circle; and a microstrip antenna spaced apart from and electrically separated from said ground plane by said dielectric substrate, said microstrip antenna being tuned over an S-Band Frequency range of 2.2 to 2.3 GHz;

said microstrip antenna including:

a circular shaped radiating patch mounted on the upper surface of dielectric substrate for transmitting an RF (radio frequency) signal having telemetry data contained therein; and a filter mounted on the lower surface of said dielectric substrate, said filter being electrically connected to said radiating patch to filter GPS (Global Positioning System) signals from the RF signal transmitted by said radiating patch.

2. The broadband telemetry antenna of claim 1 wherein said radiating patch comprises:

first and second feed points for electrically connecting said filter to said radiating patch;

first and second tuning tabs positioned diametrically opposite one another on the circumference of said radiating patch;

third and fourth tuning tabs positioned diametrically opposite one another on the circumference of said radiating patch;

said first and second tuning tabs being positioned approximately perpendicular to said third and fourth tuning stubs on the circumference of said radiating patch; and said first, second, third and fourth tuning tabs being provided to allow a user of said broadband telemetry antenna to tune said microstrip antenna over said S-Band Frequency range of 2.2 to 2.3 GHz.

3. The broadband telemetry antenna of claim 1 wherein said radiating patch has a diameter of approximately ⅞ of an inch.

4. The broadband telemetry antenna of claim 1 wherein said filter comprises:

a feed input;

first and second filter stubs connected to said feed input, said first and second filter stubs extending outward from said feed input, said first and second filter stubs positioned diametrically opposite one another on the lower surface of said dielectric substrate;

a fifty ohm transmission line having one end connected to said feed input, said fifty ohm transmission line being positioned on the lower surface of said dielectric substrate perpendicular to said first and second filter stubs;

a first one hundred ohm transmission line having one connected to said fifty ohm transmission line and the other end connected to said radiating patch, said first one hundred ohm transmission line extending from said fifty ohm transmission line at an angle of approximately 35 degrees; and a second one hundred ohm transmission line having one connected to said fifty ohm transmission line and the other end connected to said radiating patch, said second one hundred ohm transmission line extending from said fifty ohm transmission line at an angle of approximately 35 degrees.

5. The broadband telemetry antenna of claim 4 wherein said first one hundred ohm transmission line is electrically connected to said radiating patch by a first plated through connecting pin which passes through said dielectric substrate and said second one hundred ohm transmission line is electrically connected to said radiating patch by a second plated through connecting pin which passes through said dielectric substrate.

6. The broadband telemetry antenna of claim 1 wherein said radiating patch has a diameter of approximately ⅞ of an inch.

7. The broadband telemetry antenna of claim 1 wherein said broadband telemetry antenna is capable of withstanding G Forces exerted thereon of at least 80,000 Gs without damage to said broadband telemetry antenna.

8. The broadband telemetry antenna of claim 1 wherein said dielectric substrate has a diameter of approximately 1⅜ inches.

9. The broadband telemetry antenna of claim 1 wherein said radiating patch and said filter are fabricated from etched copper.

10. A broadband telemetry antenna for use on a projectile comprising:

(a) a ground plane adapted for mounting on said projectile;

(b) a dielectric substrate positioned above said ground plane, said dielectric substrate having an upper surface and a lower surface, said dielectric substrate being configured as a circle; and (c) a microstrip antenna spaced apart from and electrically separated from said ground plane by said dielectric substrate, said microstrip antenna being tuned over an S-Band Frequency range of 2.2 to 2.3 GHz, said microstrip antenna including:

(i) a circular shaped radiating patch mounted on the upper surface of dielectric substrate for transmitting an RF (radio frequency) signal having telemetry data contained therein;

(ii) said radiating patch having first and second tuning tabs positioned diametrically opposite one another on the circumference of said radiating patch, and third and fourth tuning tabs positioned diametrically opposite one another on the circumference of said radiating patch;

(iii) said first and second tuning tabs of said radiating patch being positioned approximately perpendicular to said third and fourth tuning stubs on the circumference of said radiating patch;

(iv) said first, second, third and fourth tuning tabs being provided to allow a user of said broadband telemetry antenna to tune said microstrip antenna over said S-Band Frequency range of 2.2 to 2.3 GHz;

(vii) said radiating patch having first and second feed points spaced apart from one another; and (d) a filter mounted on the lower surface of said dielectric substrate, said filter being electrically connected to the first and second feed points of said radiating patch to filter GPS (Global Positioning System) signals at a frequency of approximately 1575 MHz from the RF signal transmitted by said radiating patch.

11. The broadband telemetry antenna of claim 10 wherein said radiating patch has a diameter of approximately ⅞ of an inch.

12. The broadband telemetry antenna of claim 10 wherein said filter comprises:

a feed input;

first and second filter stubs connected to said feed input, said first and second filter stubs extending outward from said feed input, said first and second filter stubs positioned diametrically opposite one another on the lower surface of said dielectric substrate;

a fifty ohm transmission line having one end connected to said feed input, said fifty ohm transmission line being positioned on the lower surface of said dielectric substrate perpendicular to said first and second filter stubs;

a first one hundred ohm transmission line having one connected to said fifty ohm transmission line and the other end connected to the first feed point of said radiating patch, said first one hundred ohm transmission line extending from said fifty ohm transmission line at an angle of approximately 35 degrees; and a second one hundred ohm transmission line having one connected to said fifty ohm transmission line and the other end connected to the second feed point of said radiating patch, said second one hundred ohm transmission line extending from said fifty ohm transmission line at an angle of approximately 35 degrees.

13. The broadband telemetry antenna of claim 12 wherein said first one hundred ohm transmission line is electrically connected to the first feed point of said radiating patch by a first plated through connecting pin which passes through said dielectric substrate and said second one hundred ohm transmission line is electrically connected to the second feed point of said radiating patch by a second plated through connecting pin which passes through said dielectric substrate.

14. The broadband telemetry antenna of claim 10 wherein said radiating patch has a diameter of approximately ⅞ of an inch.

15. The broadband telemetry antenna of claim 10 wherein said dielectric substrate has a diameter of approximately 1⅜ inches.

16. The broadband telemetry antenna of claim 10 wherein said radiating patch and said filter are fabricated from etched copper.

17. A broadband telemetry antenna for use on a projectile comprising:

(a) a ground plane adapted for mounting on said projectile;

(b) a dielectric substrate positioned above said ground plane, said dielectric substrate having an upper surface and a lower surface, said dielectric substrate being configured as a circle; and (c) a microstrip antenna spaced apart from and electrically separated from said ground plane by said dielectric substrate, said microstrip antenna being tuned over an S-Band Frequency range of 2.2 to 2.3 GHz, said microstrip antenna including:

(i) a circular shaped radiating patch mounted on the upper surface of dielectric substrate for transmitting an RF (radio frequency) signal having telemetry data contained therein;

(ii) said radiating patch having first and second tuning tabs positioned diametrically opposite one another on the circumference of said radiating patch, and third and fourth tuning tabs positioned diametrically opposite one another on the circumference of said radiating patch;

(iii) said first and second tuning tabs of said radiating patch being positioned approximately perpendicular to said third and fourth tuning stubs on the circumference of said radiating patch;

(iv) said first, second, third and fourth tuning tabs being provided to allow a user of said broadband telemetry antenna to tune said microstrip antenna over said S-Band Frequency range of 2.2 to 2.3 GHz;

(vii) said radiating patch having first and second feed points spaced apart from one another; and (d) a filter mounted on the lower surface of said dielectric substrate, said filter being electrically connected to the first and second feed points of said radiating patch to filter GPS (Global Positioning System) signals at a frequency of approximately 1575 MHz from the RF signal transmitted by said radiating patch; and (e) said broadband telemetry antenna being capable of withstanding G Forces exerted thereon of at least 80,000 Gs without damage to said broadband telemetry antenna.

18. The broadband telemetry antenna of claim 17 wherein said radiating patch has a diameter of approximately ⅞ of an inch.

19. The broadband telemetry antenna of claim 17 wherein said filter comprises:

a feed input;

first and second filter stubs connected to said feed input, said first and second filter stubs extending outward from said feed input, said first and second filter stubs positioned diametrically opposite one another on the lower surface of said dielectric substrate;

a fifty ohm transmission line having one end connected to said feed input, said fifty ohm transmission line being positioned on the lower surface of said dielectric substrate perpendicular to said first and second filter stubs;

is a first one hundred ohm transmission line having one connected to said fifty ohm transmission line and the other end connected to the first feed point of said radiating patch, said first one hundred ohm transmission line extending from said fifty ohm transmission line at an angle of approximately 35 degrees; and a second one hundred ohm transmission line having one connected to said fifty ohm transmission line and the other end connected to the second feed point of said radiating patch, said second one hundred ohm transmission line extending from said fifty ohm transmission line at an angle of approximately 35 degrees.

20. The broadband telemetry antenna of claim 17 wherein said first one hundred ohm transmission line is electrically connected to the first feed point of said radiating patch by a first plated through connecting pin which passes through said dielectric substrate and said second one hundred ohm transmission line is electrically connected to the second feed point of said radiating patch by a second plated through connecting pin which passes through said dielectric substrate.

21. The broadband telemetry antenna of claim 17 wherein said radiating patch has a diameter of approximately ⅞ of an inch.

22. The broadband telemetry antenna of claim 17 wherein said dielectric substrate has a diameter of approximately 1⅜ inches.

23. The broadband telemetry antenna of claim 17 wherein said radiating patch and said filter are fabricated from etched copper.

* * * * *